US005822824A

United States Patent [19]

Dion

[11] Patent Number: 5,822,824

[45] **Date of Patent: *Oct. 20, 1998**

[54] MOUNTABLE WASHING DEVICE

[76] Inventor: William D. Dion, 1492 W. Straford Ave., Gilbert, Ariz. 85233-4605

[ * ] Notice: The term of this patent shall not extend beyond the expiration date of Pat. No. 5,490,302.

[21] Appl. No.: 759,781

[22] Filed: Dec. 3, 1996

[51] Int. Cl.[6] ..... A47K 7/02

[52] U.S. Cl. ..... 15/210.1; 5/244.1; 5/244.3; 5/247; 4/606

[58] Field of Search ..... 15/244.1, 244.3, 15/160, 210.1, 247; 4/606

[56] References Cited

U.S. PATENT DOCUMENTS

| | | | |
|---|---|---|---|
| 1,954,940 | 4/1934 | Mikel | 15/244.3 |
| 3,055,037 | 9/1962 | Fjelstad | 15/210.1 |
| 3,289,215 | 12/1966 | Kennedy | 15/244.1 |
| 3,750,226 | 8/1973 | Morgan | 15/244.1 |
| 4,020,519 | 5/1977 | Robison | 15/244.1 |
| 4,047,259 | 9/1977 | Lotis | 15/244.3 |
| 4,696,068 | 9/1987 | Kenner | 15/210.1 |
| 4,759,091 | 7/1988 | Kiss | 15/160 |
| 4,890,352 | 1/1990 | Stowers | 15/244.1 |
| 5,072,480 | 12/1991 | Peters | 15/160 |
| 5,175,896 | 1/1993 | Zamir | 15/160 |
| 5,311,635 | 5/1994 | Moore | 15/244.1 |
| 5,600,864 | 2/1997 | Huber | 15/244.3 |

FOREIGN PATENT DOCUMENTS

| | | | |
|---|---|---|---|
| 1229106 | 9/1960 | France | 15/244.1 |
| 2253142 | 9/1992 | United Kingdom | 15/244.1 |

*Primary Examiner*—Randall Chin
*Attorney, Agent, or Firm*—David E. Rogers; Michael A. Lechter

[57] ABSTRACT

A detachably-mountable washing device is disclosed. The washing device generally comprises a cloth support section and a mounting section attached to the cloth support section. The support section is preferably a foam pad having an attachment surface and a curved, cloth support surface. The mounting section includes a mounting surface and an attachment surface. The mounting surface comprises a plurality of suction cups and gripper ribs for retaining a wash cloth. The attachment surface is connected to the attachment surface of the pad, preferably by a hot-melt adhesive, to assemble the washing device. The assembled washing device is secured to a wall or other surface by the suction cups. A wash cloth is then placed on the support surface of the support pad and secured by pressing its edges between the gripper ribs and the surface to which the washing device is mounted.

21 Claims, 8 Drawing Sheets

MOUNTABLE WASHING DEVICE

FIELD OF THE INVENTION

This invention relates to the field of personal grooming devices and more particularly to a mountable washing device to which a wash cloth can be attached.

BACKGROUND OF THE INVENTION

The present invention was developed to fill a need for persons who desire a mountable washing device which uses a wash cloth, and preferably a standard wash cloth. Various devices for attachment to a bathroom shower or tub wall presently exist for the purpose of cleaning or massaging inaccessible areas of a person's body, particularly the back. Such devices assist the elderly, persons with arthritis and others with impaired mobility. Otherwise unimpaired persons also benefit from the presently known devices which make hard-to-reach areas of a person accessible to cleaning or massaging.

Many mountable washing devices presently known require a customized cloth cover which would be jointly used by multiple users. Using such a design creates certain sanitation problems. For instance, a person with a skin allergy could transmit the condition to other users. Other known devices use hooks or other projections to ensnare a wash cloth. Such a design is expensive to manufacture, tedious and cumbersome to use and the projections can damage the wash cloth.

SUMMARY OF THE INVENTION

The present invention solves these and other problems by providing a mountable washing device comprising a cloth support section attached to a mounting section. The cloth support section preferably comprises a foam pad designed with the proper shape and density to support the wash cloth and provide a smooth, even washing surface. The mounting section preferably comprises a one-piece platform having an attachment surface and a mounting surface preferably having four sides. The attachment surface is attached to the cloth support section, preferably by an adhesive. Suction cups are integrally formed on the mounting surface and a retention rib is preferably integrally formed along each side of the mounting surface. The assembled washing device is mounted by pressing the suction cups against a surface and suction holds the washing device in place. A wash cloth preferably having four edges is mounted to the device preferably by pressing each respective edge of the wash cloth between the gripper rib along one side of the mounting surface and the surface to which the washing device is mounted. The wash cloth is thereby retained in a substantially taut configuration across the cloth support section.

An object of the present invention is to provide for sanitary use by multiple users.

A further object of the present invention is to allow a user to use the same wash cloth on the washing device as is being used for bathing or showering purposes.

Another object of the present invention is to provide a structure(s) whereby the device may be detachably mounted to a wall having seams, such as grout lines present on tile surfaces.

Another object of the present invention is to provide a simple and effective structure for retaining a wash cloth in a substantially taut configuration.

Another object of the present invention is to provide a structure as defined above wherein the wash cloth is not torn or damaged.

Additional objects and advantages of the invention will be apparent to those skilled in the art from the description which follows, or may be learned by the practice of the invention.

BRIEF DESCRIPTION OF DRAWINGS

A preferred embodiment of the present invention is illustrated in the appended drawings, which depict only typical embodiments of the invention and therefore are not to be considered as limiting its scope.

DESCRIPTION OF THE PREFERRED EMBODIMENT

Figure 1:
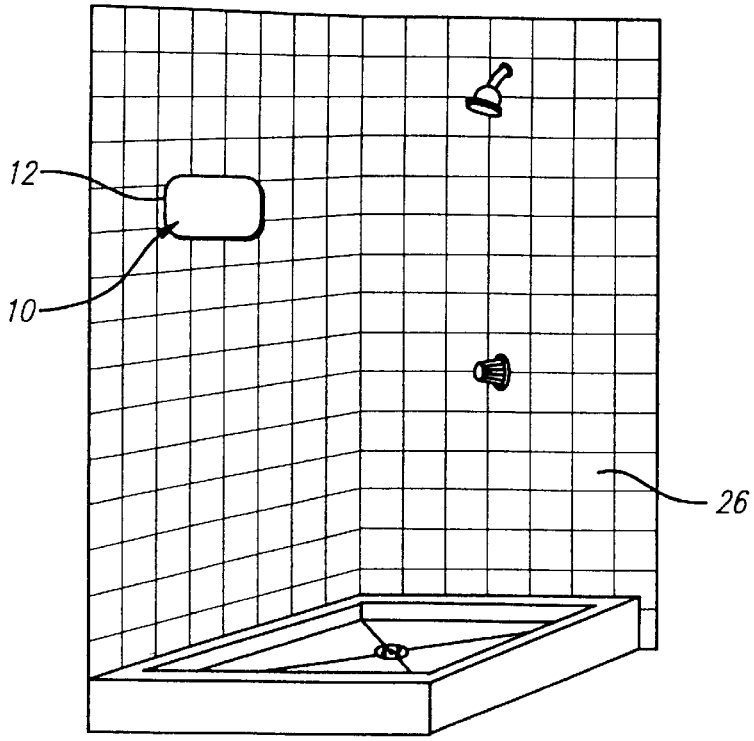
FIG. 1 is a front view of the preferred embodiment of a detachably mountable washing device mounted on a tile shower wall.
Figure 2:
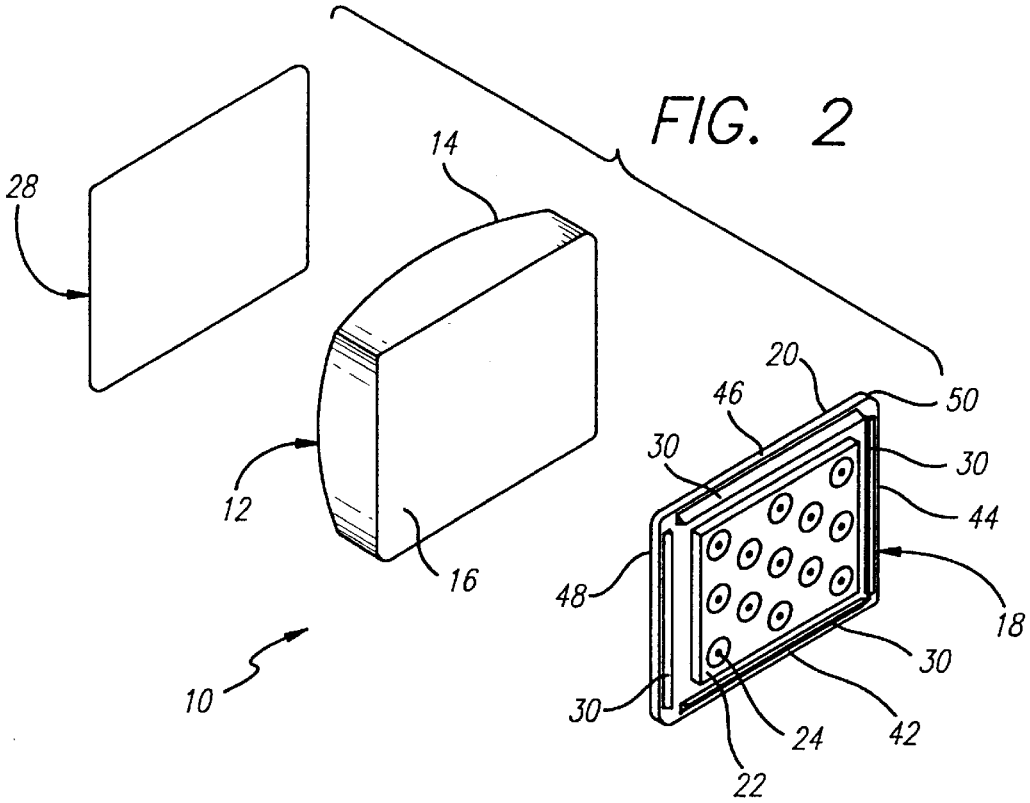
FIG. 2 is an exploded, perspective view of the invention shown in FIG. 1.

Turning first to FIGS. 1–2, in the form illustrated, the detachably mountable washing device 10 comprises a cloth support section, shown as a pad 12, which is preferably water resistant and has a generally rectangular shape. Pad 12 has a curved top side 14 and a flat bottom side 16 which is adapted to be attached to an attachment surface 20 of a mounting section, which is shown as a platform 18.

Pad 12 is preferably made of a resilient urethane foam that provides for flexibility and cushioning while applying soap, lotion or salve to an area to be washed. It has been found that a pad with the proper characteristics has a durometer of 10–12 Shore A and a density of 11–12 lbs/ft$^3$. One skilled in the art will recognize that any material that provides substantially the same flexibility and cushioning characteristics may be substituted for urethane foam.

The preferred foam pad 12 is constructed of urethane. It is in the family of water blown polyether or polyester type urethane wet pack systems. Pad 12 is preferably open celled so as to remain flexible over the range of temperatures that washing device 10 may encounter. Pad 12 is preferably water-proofed by spraying, rolling or brushing it, preferably with PDC F-717 synthetic rubber supplied by Plasti Dip International and having the following properties:

| | |
|---|---|
| Solids (wt.) 24% | Durometer Shore A (ASTM D-2240): 70 |
| Tensile strength (ASTM D-638): 2,500 psi. | Weatherability (ASTM G-53): 3–5 yrs. |
| | Permeability (ASTME96): .03 grains/ft. *hr |

-continued

| | |
|---|---|
| Cut resistance (ASTM D-1044): very good | Temperature use range: −30F to 200F |
| Viscosity range: 10,000–20,000 cps. | Elongation (ASTM D-638): 500% |
| Coverage: 30 sq. ft. at 16 mils. per gal. | Shelf Life: 1 yr. at 77° F. |
| Chemical resistance: Petroleums-limited; acids, alkalines, moisture, urine-excellent. | Dielectric (ASTM D-149): 2,600 v/mil. |

Other water-resistant coatings and other application methods may be used.

Platform 18 includes an attachment surface 20 and a mounting surface 22. Mounting surface 22 contains a plurality of suction cups 24, which are preferably integrally formed with surface 22, for attaching washing device 10 to a wall surface 26 of a shower or tub as illustrated in FIG. 1. Alternatively, other surface mounting structures may be used to detachably (preferred) or permanently mount device 10 to a surface. For example, adhesives and screws are among the mounting structures that could be used. As used herein, the term mountable refers to a device that can be detachably or permanently mounted to a surface. Furthermore, washing device 10 may be attached to any surface whereby a user may wash his/her back or other hard-to-access areas; it is not limited to being mounted to a wall. A lip 50 preferably extends substantially about the perimeter of attachment surface 20 creating a pocket to receive pad 12. Lip 50 protects the bottom edges of pad 12 and helps to secure pad 12 on surface 20.

Figure 5:
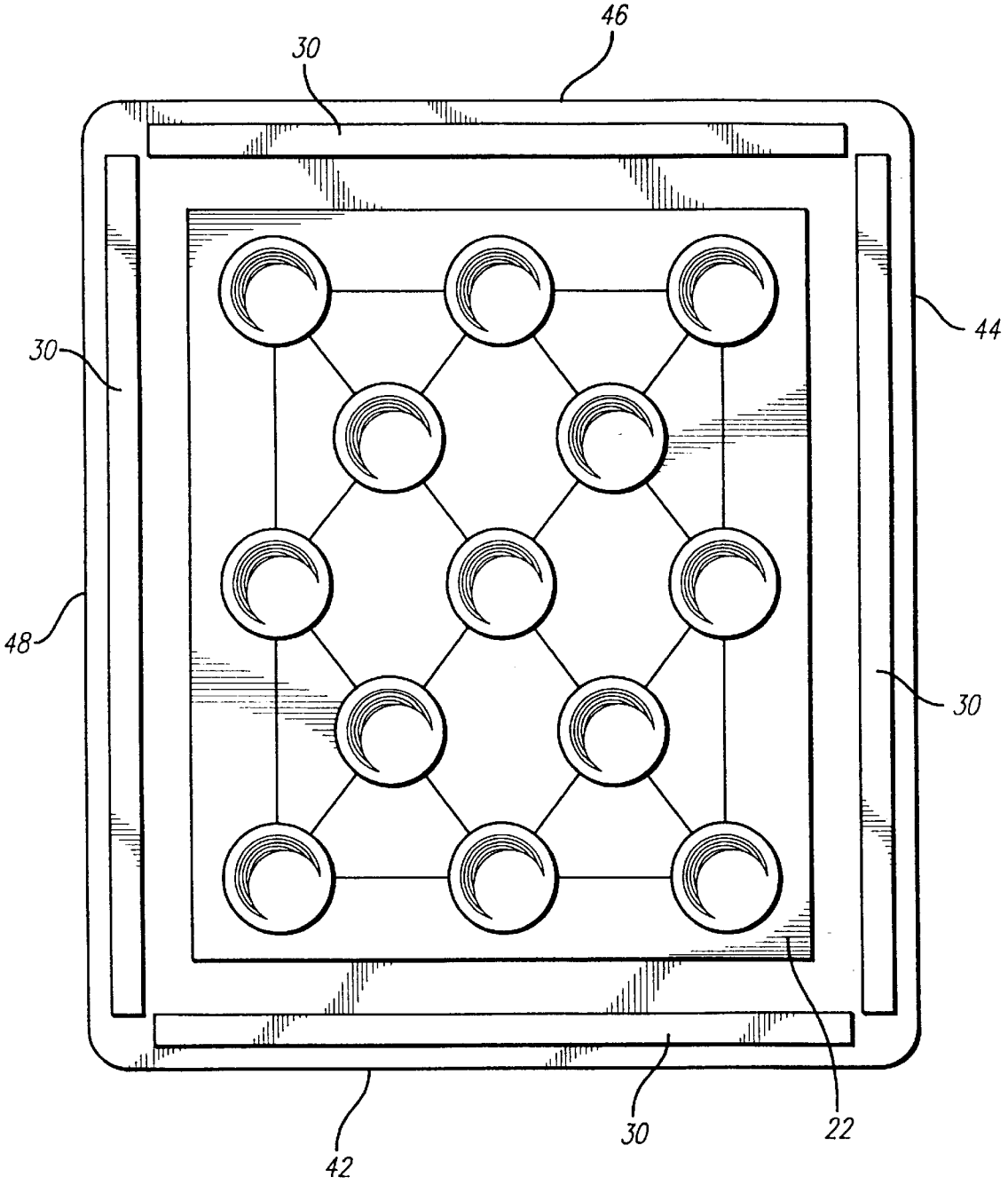
FIG. 5 is a bottom view of the invention shown in FIG. 1.
Figure 6:
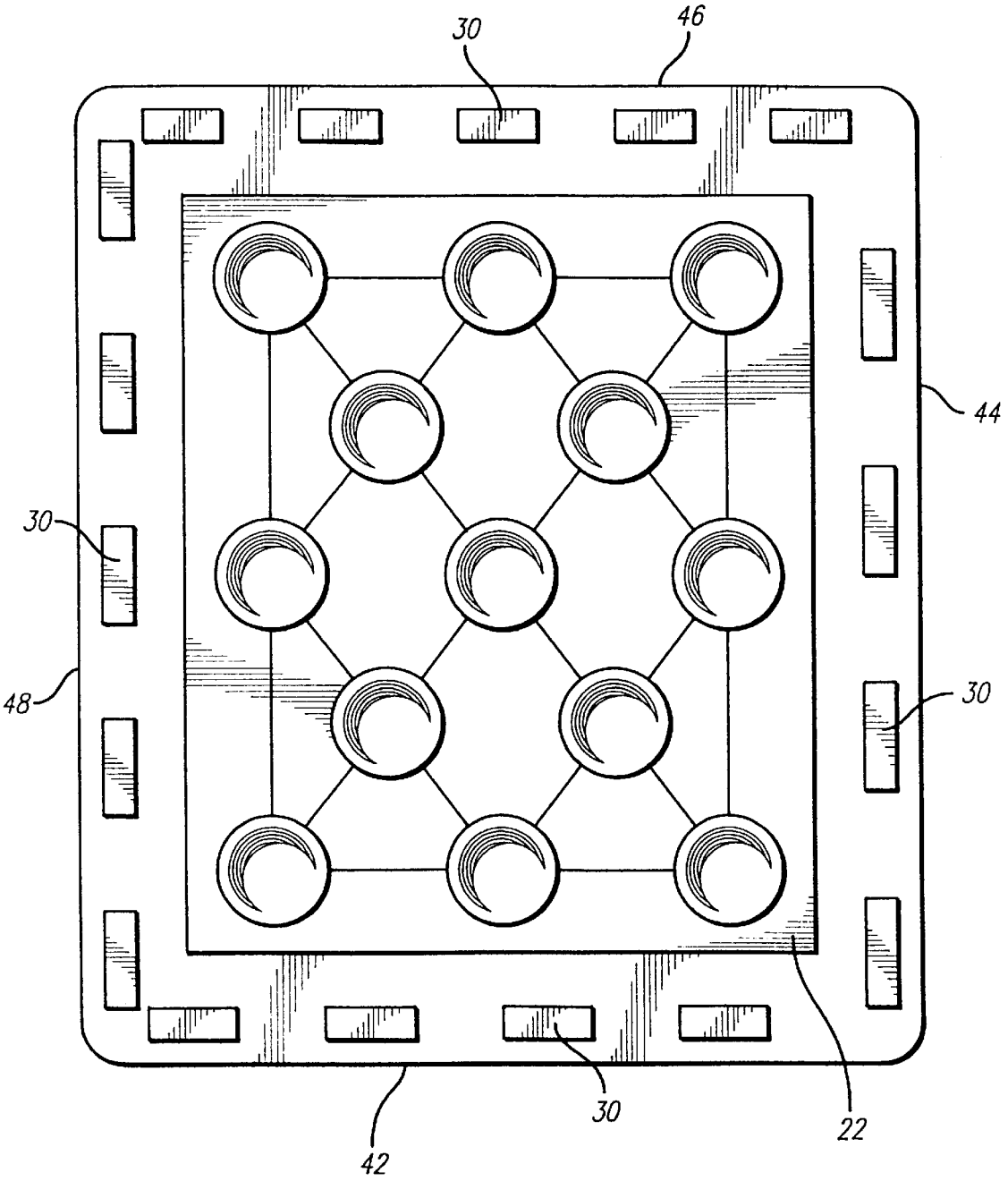
FIG. 6 is a bottom view of an alternative embodiment of the invention showing intermittent gripper ribs.
Figure 7:
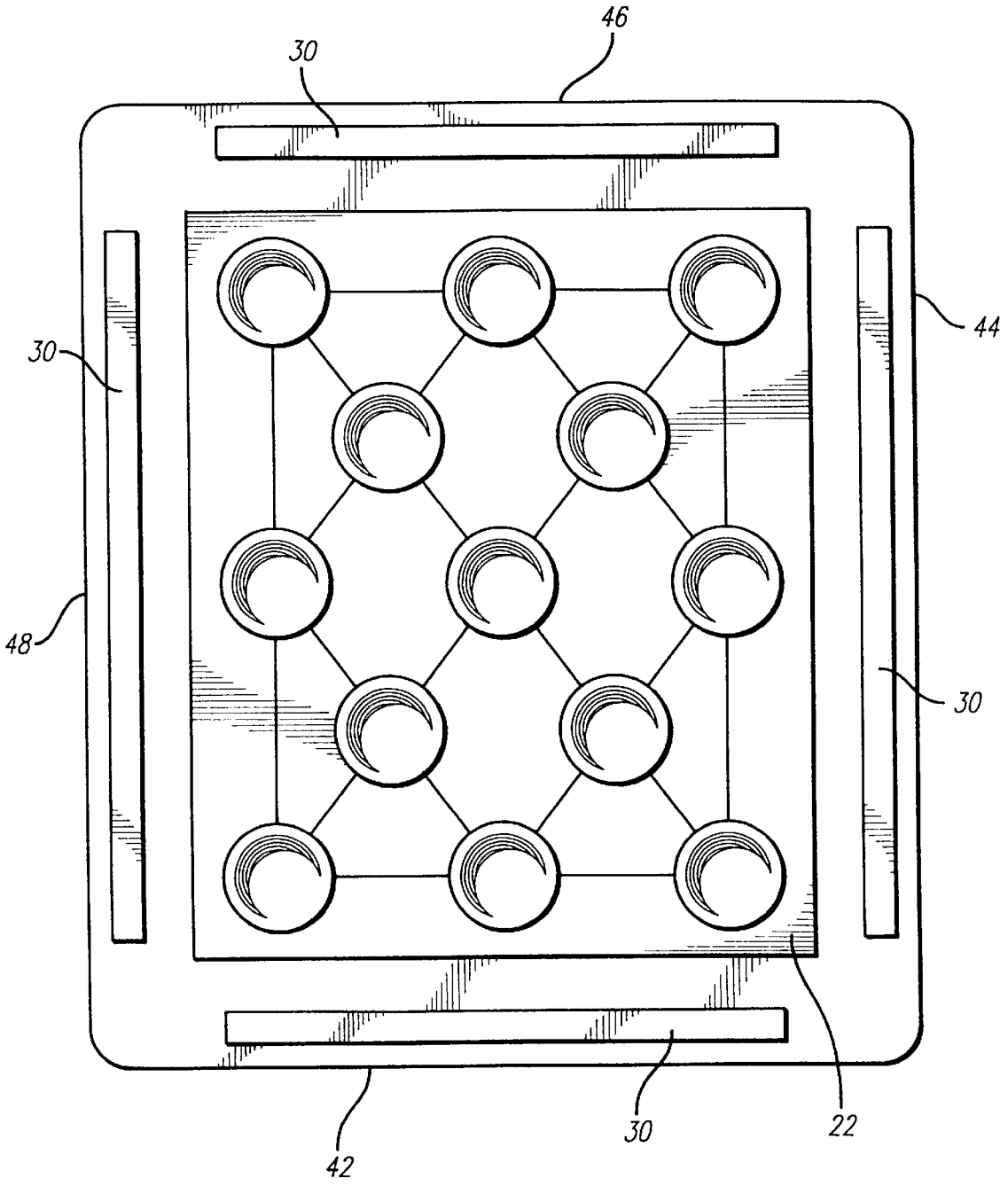
FIGS. 7 and 8, respectively, are bottom views of alternative embodiments of the invention showing ribs that do not extend substantially the entire length of each side.
Figure 8:
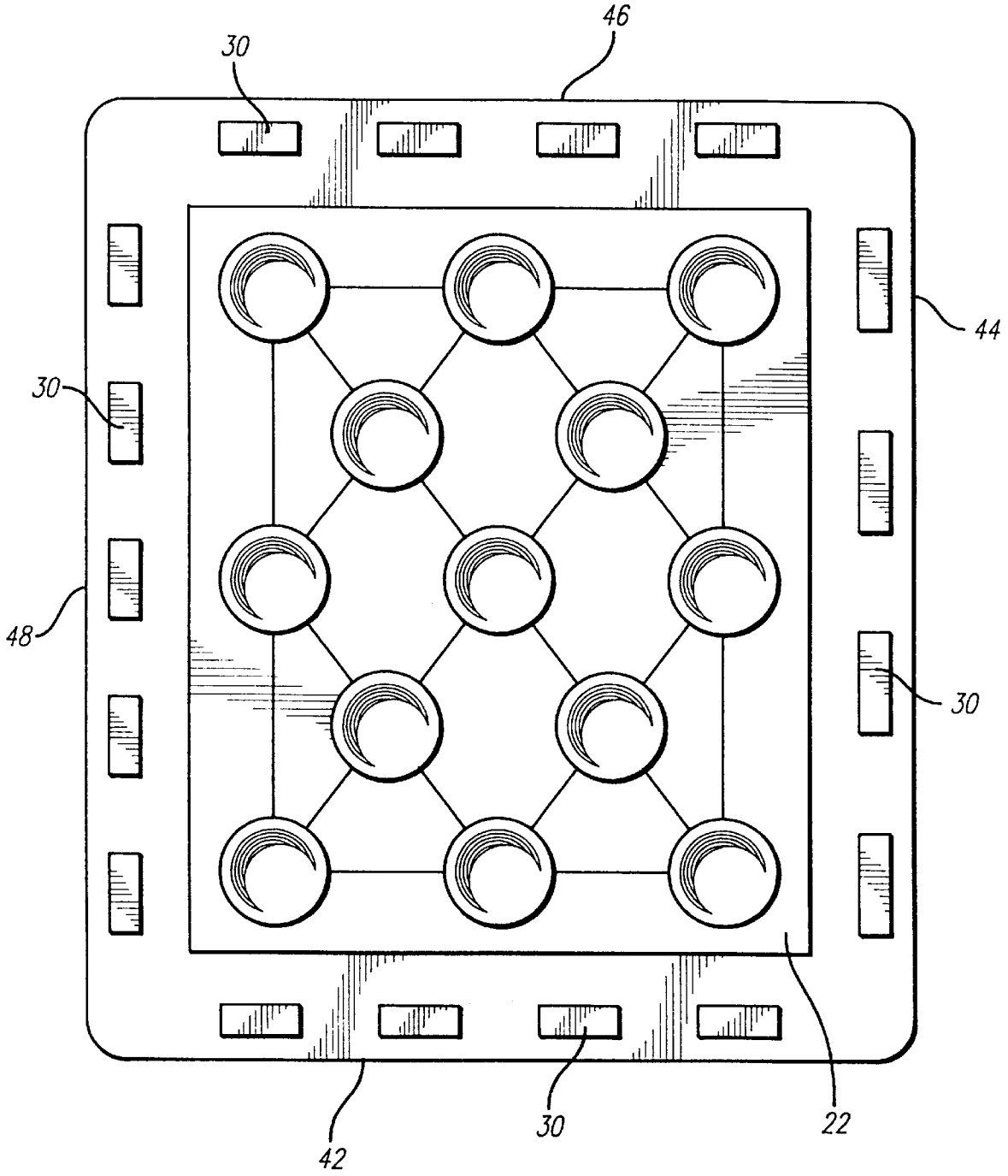
Figure 9:
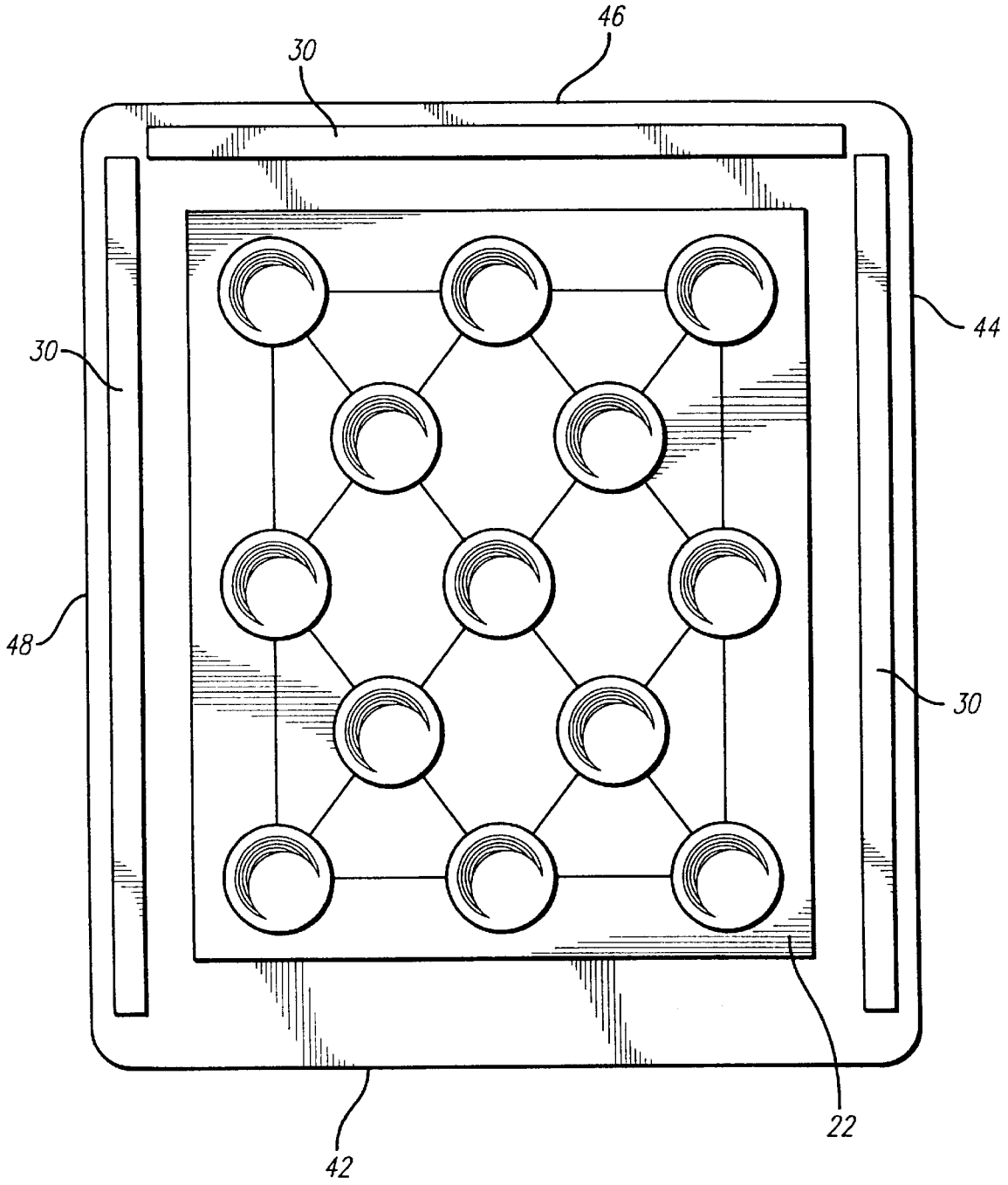
FIGS. 9 and 10, respectively, show alternative embodiments of the invention where one side, or two sides, does not include a gripper rib.
Figure 10:
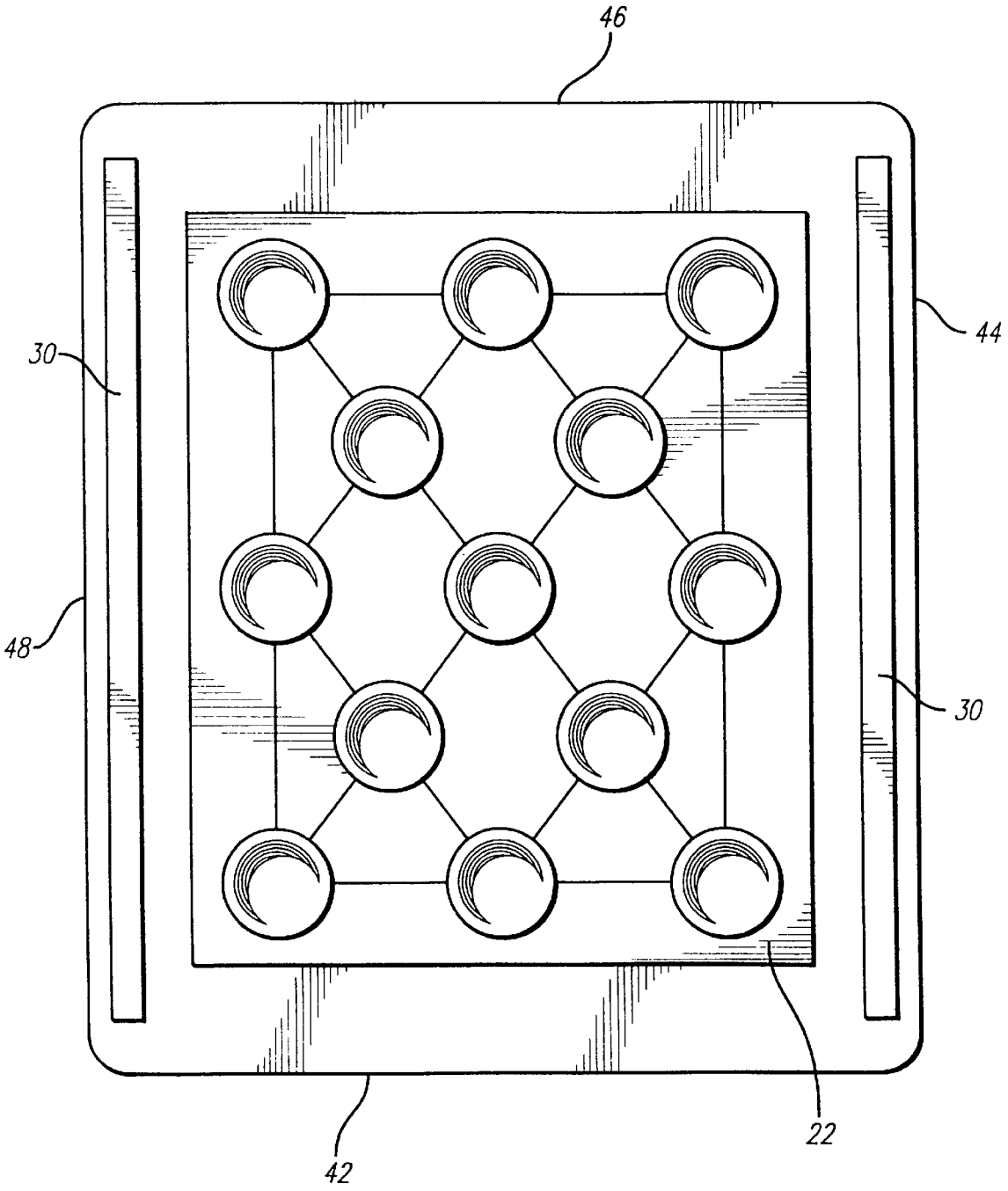

Mounting surface 22 of platform 18 includes four sides, 42, 44, 46 and 48, shown in FIGS. 2 and 5. A wash cloth 28 is secured to washing device 10 by gripper ribs 30 preferably juxtaposed each side 42, 44, 46 and 48 as best shown in FIG. 5. Each respective rib 30 may be intermittent (see FIG. 6) or continuous and may or may not extend substantially along the entire length of a side (see FIGS. 7 and 8). Furthermore, one side, either 42, 44, 46 or 48, or two opposing sides, 42, 46 or 44, 48, need not have a gripper rib 30 (see FIGS. 9 and 10). As those skilled in the art will appreciate, ribs 30 need only be designed so as to secure wash cloth 28 in a substantially taut configuration across top side 14 of pad 12. As used herein, the term substantially taut configuration means that the wash cloth can be used for its intended purpose, washing the skin of a user, without being pulled free during use. Preferably, wash cloth 28 is retained by gripper ribs 30 on each side 42, 44, 46, 48 of mounting surface 18, and most preferably the gripper ribs 30 extend along substantially the entire length of each side 42, 44, 46, 48 as shown in FIG. 5.

Figure 3:
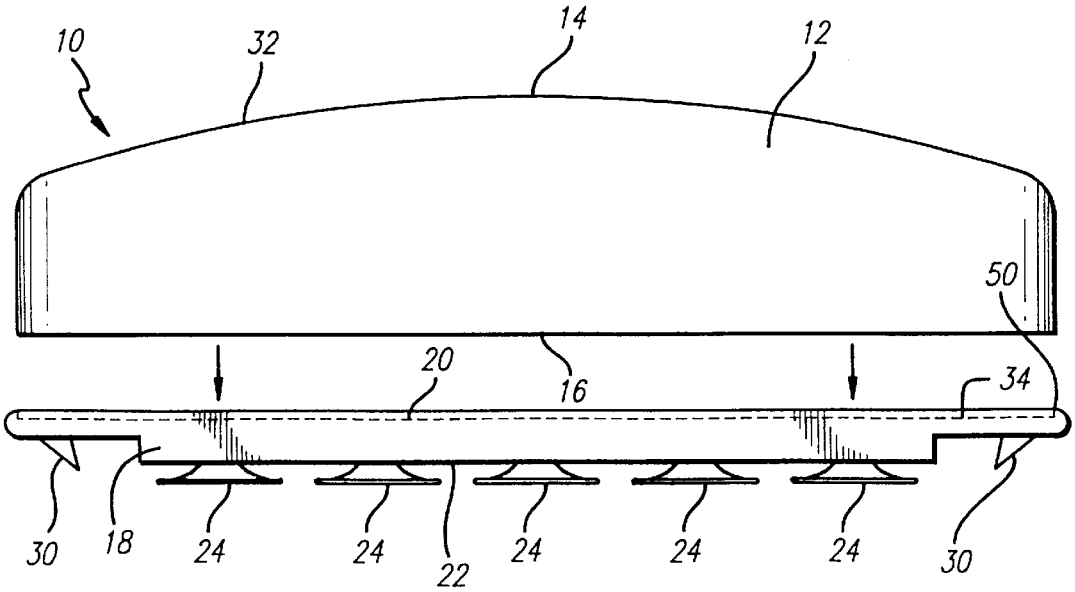
FIG. 3 is a side view of the invention shown in FIG. 1 with the pad detached from the platform and the front and rear gripper ribs removed for the purpose of revealing the structure of the platform.
Figure 4:
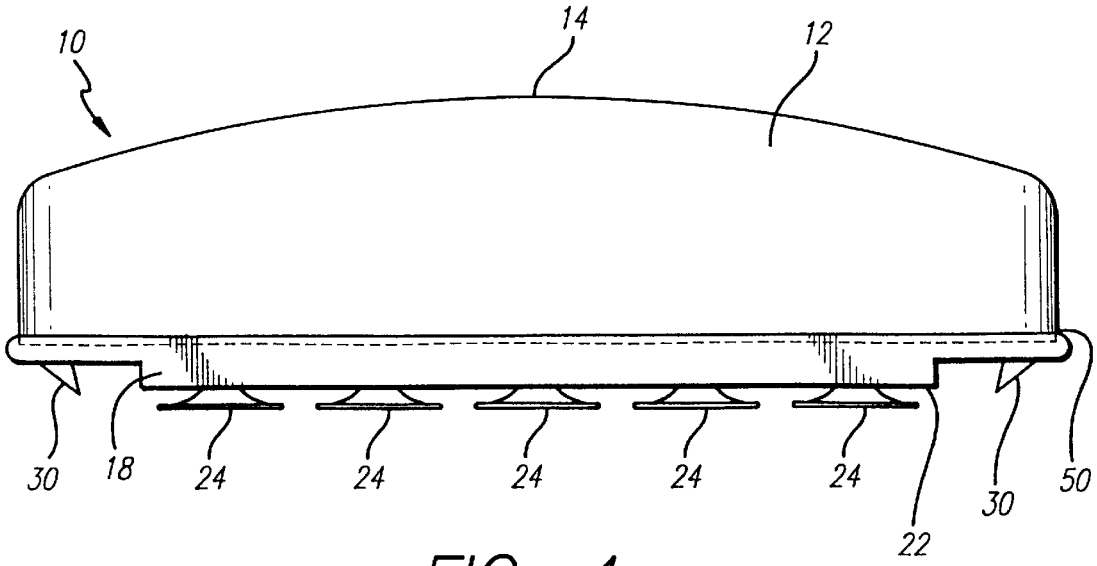
FIG. 4 is an end view of the invention shown in FIG. 1 with the side gripper ribs removed for the purpose of revealing the structure of the platform.

Washing device 10 must first be attached to a surface, such as a wall 26 in order for the preferred gripper ribs 30 to be able to secure wash cloth 28 over resilient pad 12. In the embodiment shown, each gripper rib 30 is a flexible plastic blade extending from mounting surface 22, which is best seen in FIGS. 3 and 4. Once washing device 10 is mounted, the perimeter of the platform 18 is flexed away from wall 26, preferably one side at a time, while tucking wash cloth 28 behind each respective gripper rib 30. Alternatively, each gripper rib 30 may be long enough and have the proper flexibility so that wash cloth 28 can be pushed behind it without flexing the perimeter of platform 18.

Washing device 10 requires good adherence to a wall surface because of the forces applied during use. To this end, the preferred embodiment includes thirteen suction cups 24, shown in FIG. 5, each having a diameter of approximately 1.25 inches, in staggered rows. Placement of the suction cups 24 in staggered rows insures sufficient adherence even if a number of the suction cups 24 are prevented from adhering due to grout lines or other surface irregularities.

Platform 18 is preferably made of injection-molded, flexible polyvinyl chloride, commonly known as PVC, or any other material which provides flexibility and sufficient rigidity. Platform 18 must be constructed to have the proper rigidity to hold wash cloth 28, but flexible enough to allow the perimeter to be flexed so that the wash cloth can be inserted between a rib 30 and a mounting surface 26. The flexibility of platform 18 is also an important consideration if suction cups 24 or ribs 30 are to be integrally molded with it, as suction cups 24 and ribs 30 require a certain amount of flexibility to function properly. Preferably a plastic having a durometer of 68 Shore A is used. The attachment surface 20 of mounting platform 18 preferably includes a recessed area 34, shown in phantom in FIG. 4, for inserting pad 12. Recessed area 34 helps to ensure that pad 12 does not separate from mounting platform 18 while flexing either of the four sides of platform 18 during attachment of wash cloth 28. Pad 12 is bonded to attachment surface 20 with a water-resistant, temperature variable adhesive, which is preferably a hot-melt adhesive. Alternatively, mounting platform 18 and pad 12 may be integrally formed or connected by any suitable means.

Washing device 10 preferably utilizes a standard-sized wash cloth 28, of approximately 12 to 13 inches in length and approximately 12 to 13 inches in width. Washing device 10 may, however, be used with any wash cloth. Washing device 10 eliminates the need for a customized cloth cover such as those required by the devices taught in U.S. Pat. Nos. 4,696,068 and 3,750,226, although a customized cloth may be used.

The described embodiments are to be considered in all respects only as illustrative and not restrictive. The scope of the invention is, therefore, indicated by the appended claims and the legal equivalents thereof.

What is claimed is:

1. A mountable washing device comprising:

(a) a mounting section including an attachment surface and a mounting surface, said mounting surface having a plurality of sides, said mounting surface comprising:

(i) a surface mounting structure for mounting said washing device to a surface; and (ii) a flexible gripper rib juxtaposed each of said sides for securing a wash cloth in a substantially taut configuration; and (b) a cloth support section connected to said attachment surface of said mounting section, said cloth support section having an upper surface for supporting a wash cloth;

whereby a washcloth is retained by said washing device by being tucked behind said gripper rib without puncturing the washcloth.

2. A device as defined in claim 1, wherein said surface mounting structure comprises suction cups.

3. A device as defined in claim 1, wherein said gripper ribs are integrally formed with said mounting surface.

4. A device as defined in claim 1, wherein a gripper rib juxtaposed one of said sides is intermittent.

5. A device as defined in claim 1, wherein a gripper rib juxtaposed one of said sides extends substantially along the entire length of said side.

6. A device as defined in claim 5, wherein each of said gripper ribs extends substantially along the side of which it is juxtaposed.

7. A device as defined in claim 1, wherein said mounting section is comprised of polyvinyl chloride.

8. A device as defined in claim 7, wherein said mounting section has a durometer of 68 Shore A.

9. A device as defined in claim 1, wherein said cloth support section includes a water-proof coating.

10. A device as defined in claim 9, wherein said coating comprises synthetic rubber.

11. A device as defined in claim 1, wherein said cloth support section in urethane.

12. A device as defined in claim 11, wherein said cloth support section has a durometer of 10–12 Shore A.

13. A device as defined in claim 12, wherein said cloth support section has a density of 10–12 lbs/ft$^3$.

14. A device as defined in claim 1, wherein said cloth support section is adhesively connected to said attachment surface.

15. A mountable washing device comprising:

a. a mounting section, including an attachment surface and a mounting surface, said mounting surface including a plurality of suction cups for detachably mounting the washing device to a wall, said mounting surface further including four sides and a flexible gripper rib juxtaposed each of said sides; and b. a cloth support section having atop side and a bottom side, wherein the bottom side is attached to said attachment surface;

whereby a washcloth is retained by said washing device by being tucked behind said gripper rib without puncturing the washcloth.

16. A device as defined in claim 15, wherein each gripper rib extends substantially the entire length of the side to which it is juxtaposed.

17. A device as defined in claim 15, wherein the suction cups are 1.25 inch in diameter.

18. A device as defined in claim 15, wherein at least one of said gripper ribs is intermittent.

19. A device as defined in claim 15, wherein said mounting section and said cloth support section are attached by an adhesive.

20. A mountable washing device comprising:

(a) a mounting section including an attachment surface and a mounting surface, said mounting surface having a plurality of sides and comprising:

(i) a surface mounting structure; and (ii) flexible gripper means for securing a standard wash cloth in a substantially taut configuration without puncturing the washcloth; and (b) a cloth support section attached to said attachment surface of said mounting section.

21. A mountable washing device as defined in claim 20 wherein said gripper means are flexible, plastic projections.

* * * * *